US010839753B2

(12) United States Patent
Lin et al.

(10) Patent No.: US 10,839,753 B2
(45) Date of Patent: Nov. 17, 2020

(54) HIGH FRAME RATE DISPLAY

(71) Applicant: Apple Inc., Cupertino, CA (US)

(72) Inventors: Chin-Wei Lin, San Jose, CA (US); Majid Gharghi, San Carlos, CA (US); Mohammad Reza Esmaeili Rad, San Jose, CA (US); Yun Wang, Cupertino, CA (US); Jie Won Ryu, Campbell, CA (US); Kingsuk Brahma, Mountain View, CA (US); Shingo Hatanaka, Cupertino, CA (US); Shinya Ono, San Jose, CA (US); Ting-Kuo Chang, San Jose, CA (US)

(73) Assignee: Apple Inc., Cupertino, CA (US)

( * ) Notice: Subject to any disclaimer, the term of this patent is extended or adjusted under 35 U.S.C. 154(b) by 94 days.

(21) Appl. No.: 16/134,802

(22) Filed: Sep. 18, 2018

(65) Prior Publication Data

US 2019/0088207 A1 Mar. 21, 2019

Related U.S. Application Data

(63) Continuation of application No. 62/561,583, filed on Sep. 21, 2017.

(51) Int. Cl.
*G09G 3/3275* (2016.01)
*G09G 3/3233* (2016.01)
(Continued)

(52) U.S. Cl.
CPC ..... *G09G 3/3275* (2013.01); *G09G 3/20* (2013.01); *G09G 3/3233* (2013.01);
(Continued)

(58) Field of Classification Search
CPC ..... G09G 3/3275; G09G 3/20; G09G 3/3233; G09G 2300/0819; G09G 2303/0205;
(Continued)

(56) References Cited

U.S. PATENT DOCUMENTS 8,169,556 B2 5/2012 Oh et al.
8,847,867 B2 9/2014 Zhang
(Continued)

FOREIGN PATENT DOCUMENTS

EP 2189969 A2 * 5/2010 ..... G09G 3/3688
EP 2189969 A2 5/2010

*Primary Examiner* — Mark Edwards
(74) *Attorney, Agent, or Firm* — Treyz Law Group, P.C.; George Victor Treyz; Jason Tsai

(57) ABSTRACT

A display may have rows and columns of pixels. Gate lines may be used to supply gate signals to rows of the pixels. Data lines may be used to supply data signals to columns of the pixels. The data lines may include alternating even and odd data lines. Data lines may be organized in pairs each of which includes one of the odd data lines and an adjacent one of the even data lines. Demultiplexer circuitry may be configured dynamically during data loading and pixel sensing operations. During data loading, data from display driver circuitry may be supplied, alternately to odd pairs of the data lines and even pairs of the data lines. During sensing, the demultiplexer circuitry may couple a pair of the even data lines to sensing circuitry in the display driver circuitry and then may couple a pair of the odd data lines to the sensing circuitry.

20 Claims, 15 Drawing Sheets

(51) Int. Cl.
*G09G 3/3266* (2016.01)
*G09G 3/20* (2006.01)

(52) U.S. Cl.
CPC ... *G09G 3/3266* (2013.01); *G09G 2300/0819* (2013.01); *G09G 2310/021* (2013.01); *G09G 2310/0205* (2013.01); *G09G 2310/0213* (2013.01); *G09G 2310/0218* (2013.01); *G09G 2310/0297* (2013.01); *G09G 2310/08* (2013.01); *G09G 2320/0209* (2013.01); *G09G 2320/0219* (2013.01); *G09G 2320/0252* (2013.01)

(58) Field of Classification Search
CPC .... G09G 3/021; G09G 3/0213; G09G 3/0218; G09G 3/0297; G09G 2320/0209; G09G 3/0219; G09G 3/0252
USPC ..... 345/214
See application file for complete search history.

(56) References Cited

U.S. PATENT DOCUMENTS

2005/0100057 A1* 5/2005 Shin ..... G09G 3/3283 370/536
2005/0119867 A1* 6/2005 Shin ..... G09G 3/3283 702/189
2005/0168491 A1* 8/2005 Takahara ..... G09G 3/3241 345/690
2008/0024408 A1 1/2008 Sano et al.
2011/0122173 A1* 5/2011 Sehata ..... G09G 3/2092 345/690
2011/0248906 A1 10/2011 Asano
2013/0147690 A1* 6/2013 Kim ..... G09G 3/3233 345/76
2017/0025487 A1 1/2017 Byun et al.
2017/0076665 A1* 3/2017 Kim ..... G09G 3/3275
2017/0125506 A1* 5/2017 Kim ..... H01L 27/3265

* cited by examiner

HIGH FRAME RATE DISPLAY

This application claims the benefit of provisional patent application No. 62/561,583, filed Sep. 21, 2017, which is hereby incorporated by reference herein in its entirety.

BACKGROUND

This relates generally to electronic devices, and, more particularly, to electronic devices with displays.

Electronic devices such as cellular telephones, computers, and other electronic devices often contain displays. A display includes an array of pixels for displaying images. Display driver circuitry such as data line driver circuitry may supply data signals to the pixels. Gate line driver circuitry in the display driver circuitry can be used to provide control signals to the pixels.

It can be challenging to provide display driver circuitry for a display. If care is not taken, frame rates will be too low or display performance will otherwise not be satisfactory.

SUMMARY

A display may have rows and columns of pixels. Gate lines may be used to supply gate line signals to rows of the pixels. Data lines may be used to supply data signals to columns of the pixels. The data lines may include alternating even and odd data lines. Data lines may be organized in pairs each of which includes one of the odd data lines and an adjacent one of the even data lines. Columns of pixels with mirrored layouts may flank each pair of data lines.

Demultiplexer circuitry may be configured dynamically during data loading and pixel sensing operations. During data loading, data from display driver circuitry may be supplied, alternately, to odd pairs of the data lines and even pairs of the data lines. During sensing, the demultiplexer circuitry may couple a pair of the even data lines to sensing circuitry in the display driver circuitry and then may couple a pair of the odd data lines to the sensing circuitry.

Configurations in which pixels in alternating rows are coupled alternately to the odd and even data lines and configurations in which rows of pixels each include multiple gate lines may also be used.

DETAILED DESCRIPTION

Figure 1:
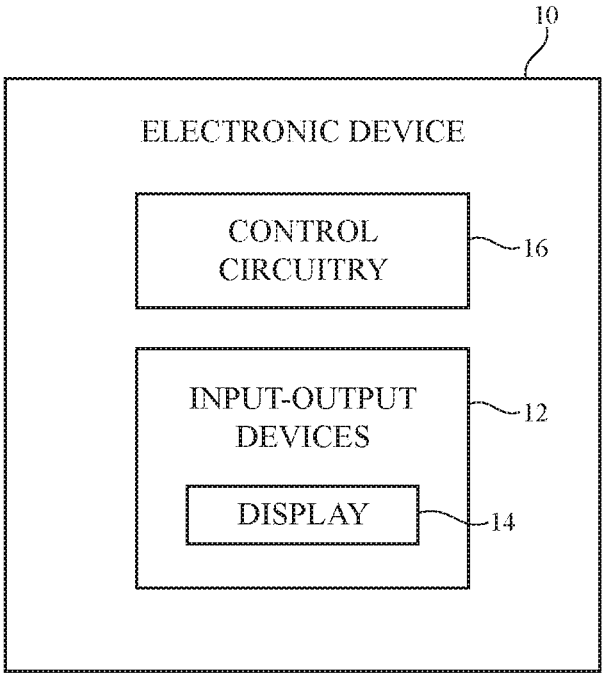
FIG. 1 is a schematic diagram of an illustrative electronic device having a display in accordance with an embodiment.

An illustrative electronic device of the type that may be provided with a display is shown in FIG. 1. Electronic device 10 of FIG. 1 may be a tablet computer, laptop computer, a desktop computer, a monitor that includes an embedded computer, a monitor that does not include an embedded computer, a display for use with a computer or other equipment that is external to the display, a cellular telephone, a media player, a wristwatch device or other wearable electronic equipment, or other suitable electronic device.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 using an array of pixels in display 14.

Display 14 may have a rectangular shape (i.e., display 14 may have a rectangular footprint and a rectangular peripheral edge that runs around the rectangular footprint) or may have other suitable shapes. Display 14 may be planar or may have a curved profile. Display 14 may be an organic light-emitting diode display or other suitable type of display.

Figure 2:
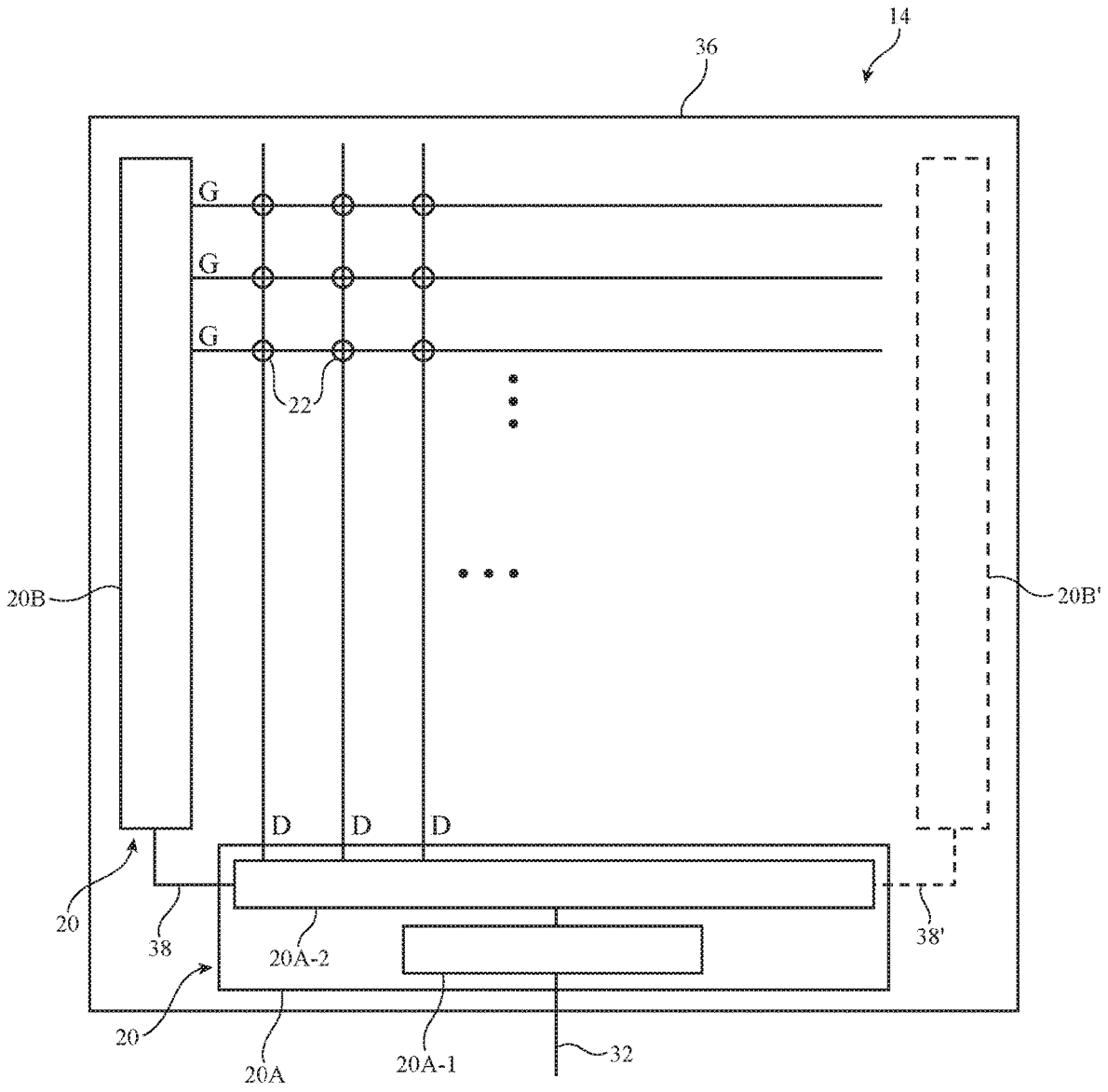
FIG. 2 is a top view of an illustrative display in an electronic device in accordance with an embodiment.

A top view of a portion of display 14 is shown in FIG. 2. As shown in FIG. 2, display 14 may have an array of pixels 22 formed from substrate structures such as substrate 36. Substrates such as substrate 36 may be formed from glass, metal, plastic, ceramic, or other substrate materials. Pixels 22 may receive data signals over signal paths such as data lines D and may receive one or more control signals over control signal paths such as gate lines G (sometimes referred to as control lines, scan lines, emission enable control lines, gate signal paths, etc.). There may be any suitable number of rows and columns of pixels 22 in display 14 (e.g., tens or more, hundreds or more, or thousands or more). Pixels 22 may have different colors (e.g., red, green, and blue) to provide display 14 with the ability to display color images. Pixels 22 may contain respective light-emitting diodes and pixel circuits that control the application of current to the light-emitting diodes. The pixel circuits in pixels 22 may contain transistors (e.g., thin-film transistors on substrate 36) having gates that are controlled by gate line signals on gate lines G.

Display driver circuits 20 may be used to control the operation of pixels 22. Display driver circuits 20 may be formed from integrated circuits, thin-film transistor circuits, or other suitable circuitry. Thin-film transistor circuitry for display driver circuits 20 and pixels 22 may be formed from polysilicon thin-film transistors, semiconducting-oxide thin-film transistors such as indium gallium zinc oxide transistors, or thin-film transistors formed from other semiconductors.

Display driver circuits 20 may include display driver circuits such as display driver circuitry 20A and gate driver circuitry 20B. Display driver circuitry 20A may include a display driver circuit 20A-1 that is formed from one or more display driver integrated circuits (e.g., timing controller integrated circuits) and/or thin-film transistor circuitry and may include demultiplexer circuitry 20A-2 (e.g., a demultiplexer formed from thin-film transistor circuitry or formed in an integrated circuit). Gate driver circuitry 20B may be formed from gate driver integrated circuits or may be formed from thin-film transistor circuitry.

Display driver circuitry 20A may contain communications circuitry for communicating with system control circuitry such as control circuitry 16 of FIG. 1 over path 32. Path 32 may be formed from traces on a flexible printed circuit or other conductive lines. During operation, the control circuitry (e.g., control circuitry 16 of FIG. 1) may supply circuitry 20A with information on images to be displayed on display 14.

To display images on display pixels 22, display driver circuitry 20A may supply image data to data lines D while issuing control signals (e.g., clock signals, a gate start pulse, etc.) to supporting display driver circuitry such as gate driver circuitry 20B over path 38. Circuitry 20A may also dynamically adjust demultiplexer circuitry 20A-2 by suppling clock signals (select signals) and other control signals to demultiplexer circuitry 20A-2.

Figure 3:
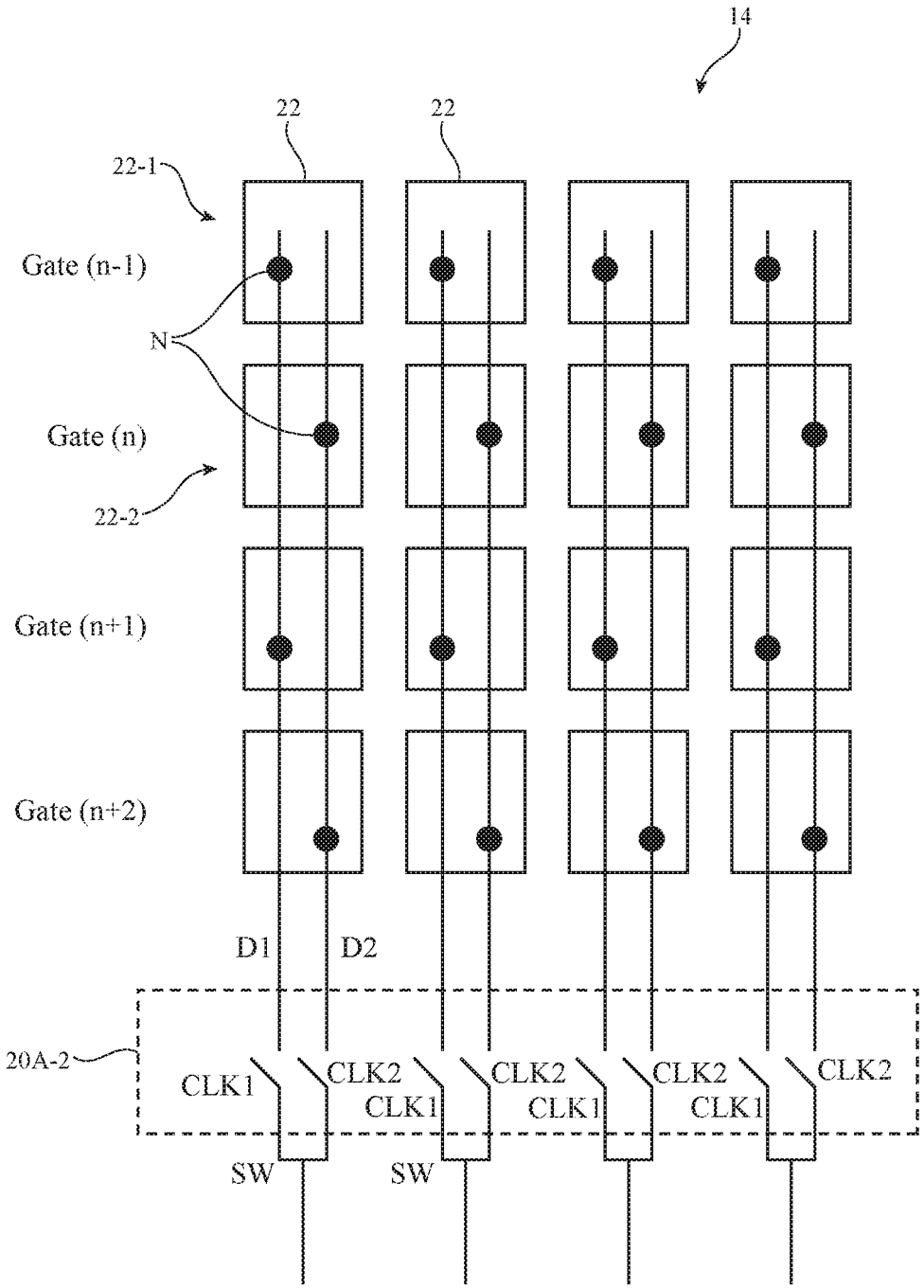
FIG. 3 is a circuit diagram of illustrative multiplexer and pixel circuitry in a display in accordance with an embodiment.
Figure 4:
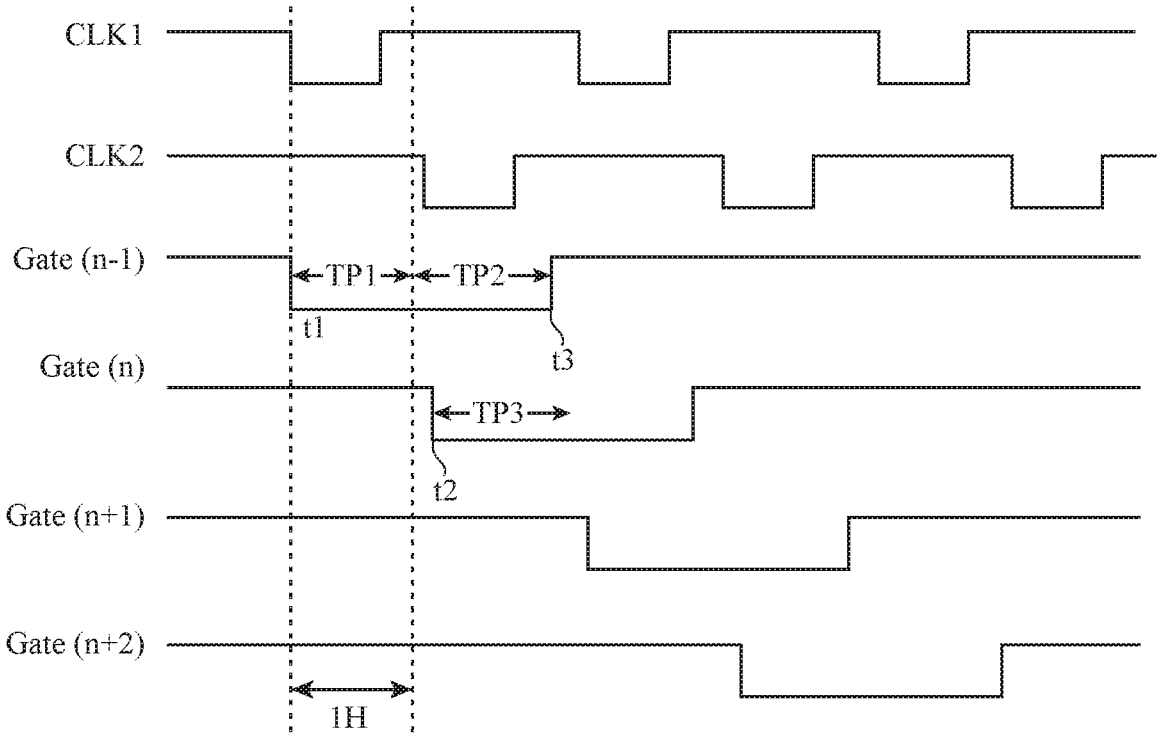
FIG. 4 is a timing diagram of illustrative control signals in a display in accordance with an embodiment.

In some configurations for display 14, each column of pixels 22 may include multiple data lines (e.g., at least two, at least three, etc.). An illustrative configuration for display 14 in which each column of pixels 22 include a pair of data lines D is shown in FIG. 3. A gate line may be associated with each row of pixels 22. Nodes N show where data lines D are coupled to the pixel circuits of pixels 22. Along each column, pixels are alternately coupled to odd and even data lines in each pair of data lines. As shown in FIG. 3, demultiplexer circuitry 20A-2 may contain switches SW that are controlled using control signals CLK1 and CLK2. FIG. 4 is a timing diagram showing signals that may be used in controlling display 14 of FIG. 3.

In high frame rate configurations for display 14, the row time ("1H" of FIG. 4) associated with controlling rows of pixels 22 tends to decrease. This can make it difficult to complete desired control operations (e.g., to load data into each row of pixels 22). By using multiple data lines per column of pixels 22, the control signals (e.g., the gate signals of FIG. 4) in successive rows can be staggered and can overlap in time, allowing each gate signal to be asserted for more than one row time (e.g., more than 1H). Consider, as an example, the loading of pixel 22-1 in row n−1 of FIG. 3 and the loading of pixel 22-2 in row n of FIG. 3. As shown in FIG. 4, gate signal gate(n−1) is taken low at time t1. Pixel 22-1 can then be loaded via data line D1. Loading can start during time period TP1 and can finish during time period TP2. At time t2, before the signal gate(n−1) is deasserted at time t3, gate signal gate(n) is asserted in row n. This allows pixel 22-2 to be loaded by data line D2. It is not necessary for gate signal gate(n−1) to complete before gate signal gate(n) is asserted, because pixel 22-1 is not coupled to date lines D2 (pixel 22-1 is coupled to data line D1 by a node N, but no nodes N couple pixel 22-1 to data line D2). As shown in FIG. 4, each gate signal may have a pulse width that is greater than the pulse widths of clocks CLK1 and CLK2.

Figure 5:
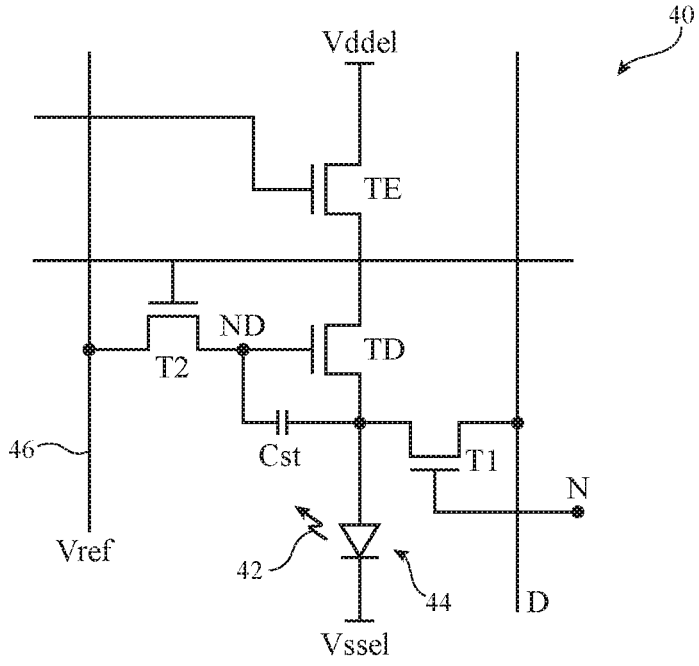
FIG. 5 is an illustrative pixel circuit in a display in accordance with an embodiment.

Any suitable pixel circuit may be used for forming pixels 22 in display 14. An illustrative pixel circuit is shown in FIG. 5. Other pixel circuitry may be used, if desired.

In the illustrative configuration of FIG. 5, pixel circuit 40 has switching transistors T1 and T2, drive transistor TD, and emission enable transistor TE. Transistors T1 and T2 are controlled by gate signals from gate driver circuitry 20B while data is provided via data line D. Storage capacitor Cst is used to retain data on node ND during emission operations. Reference voltage line Vref may be used in supplying a reference voltage Vref to pixel circuit 40. During sensing operations (for threshold voltage compensation measurements), data line D may be used to sense the current associated with the pixel. Drive transistor TD and enable transistor TE are coupled in series between positive power supply terminal Vddel and negative (ground) power supply terminal Vssel. When transistor TE is on, emission is enabled and the amount of light 42 that is emitted from light-emitting diode 48 is determined by the current flowing through transistor TD. This current is determined based on the magnitude of the signal on node ND, which is coupled to the gate of transistor TD.

Figure 6:
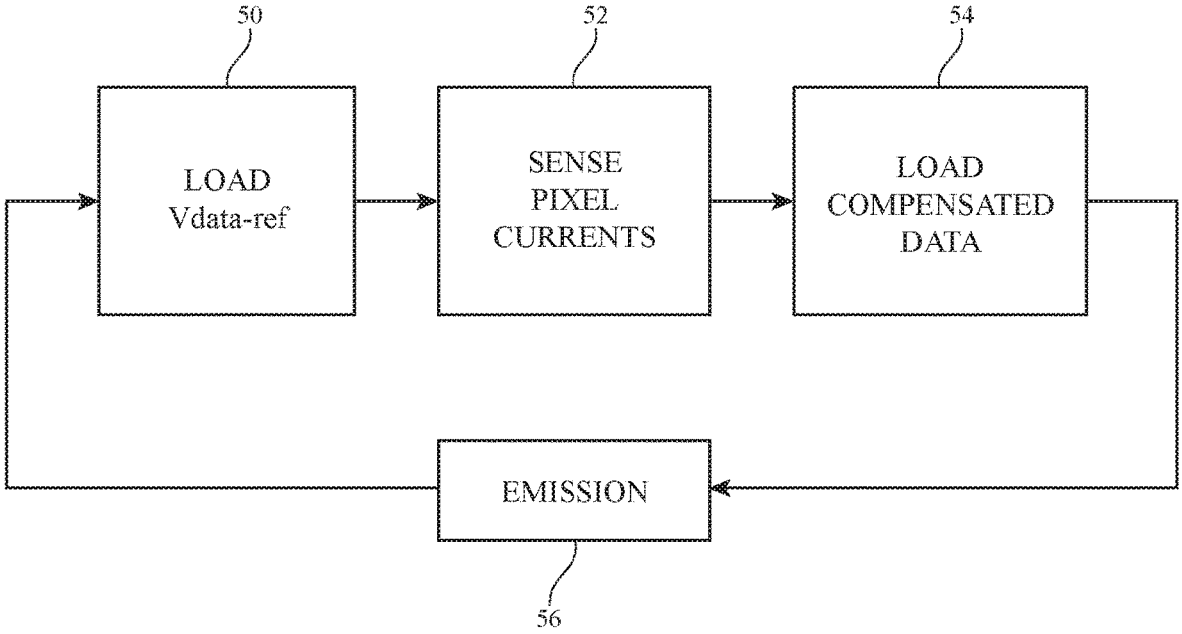
FIG. 6 is a flow chart of illustrative operations associated with operating a display in accordance with an embodiment.

A flow chart of illustrative operations involved in displaying an image frame using pixels 22 (e.g., pixels 22 with pixel circuit 40 of FIG. 5) is shown in FIG. 6. During the operations of block 50, transistors T1 and T2 are turned on and reference data Vdata-ref is loaded onto node ND. During the operations of block 52, sensors (e.g., current sensors) in circuitry 20A are used to sense pixel currents via data lines D. During pixel sensing operations, transistor T2 is turned off, transistor TE is turned on. Transistor T1 is on and allows the pixel current to flow through transistors TE and T1 to data line D for sensing. The sensed current is indicative of the threshold voltage of transistor TD. Following the sensing operations of block 52, a frame of corresponding pixel compensation values (e.g., digital values) can be produced by circuitry 20A. This frame of compensation data can be used to compensate an image frame for threshold voltage variations among pixels 22. The image frame (e.g., an image frame of data values for each pixel that have been compensated with the compensation data in the frame of compensation data) can be loaded into pixels 22 during the operations of block 54. During the operations of block 54, transistors T1 and T2 may be turned on for data loading while transistor TE is turned off. Compensated data is loaded into each pixel using data lines D. During the operations of block 56, transistors T1 and T2 are off and transistor TE is on to enable current to flow through light-emitting diode 44. The amount of current that flows through diode 44 and therefore the amount of light 42 that is emitted by diode 44 is determined by the current flowing through drive transistor TD, which is determined by the data on node ND.

Figure 7:
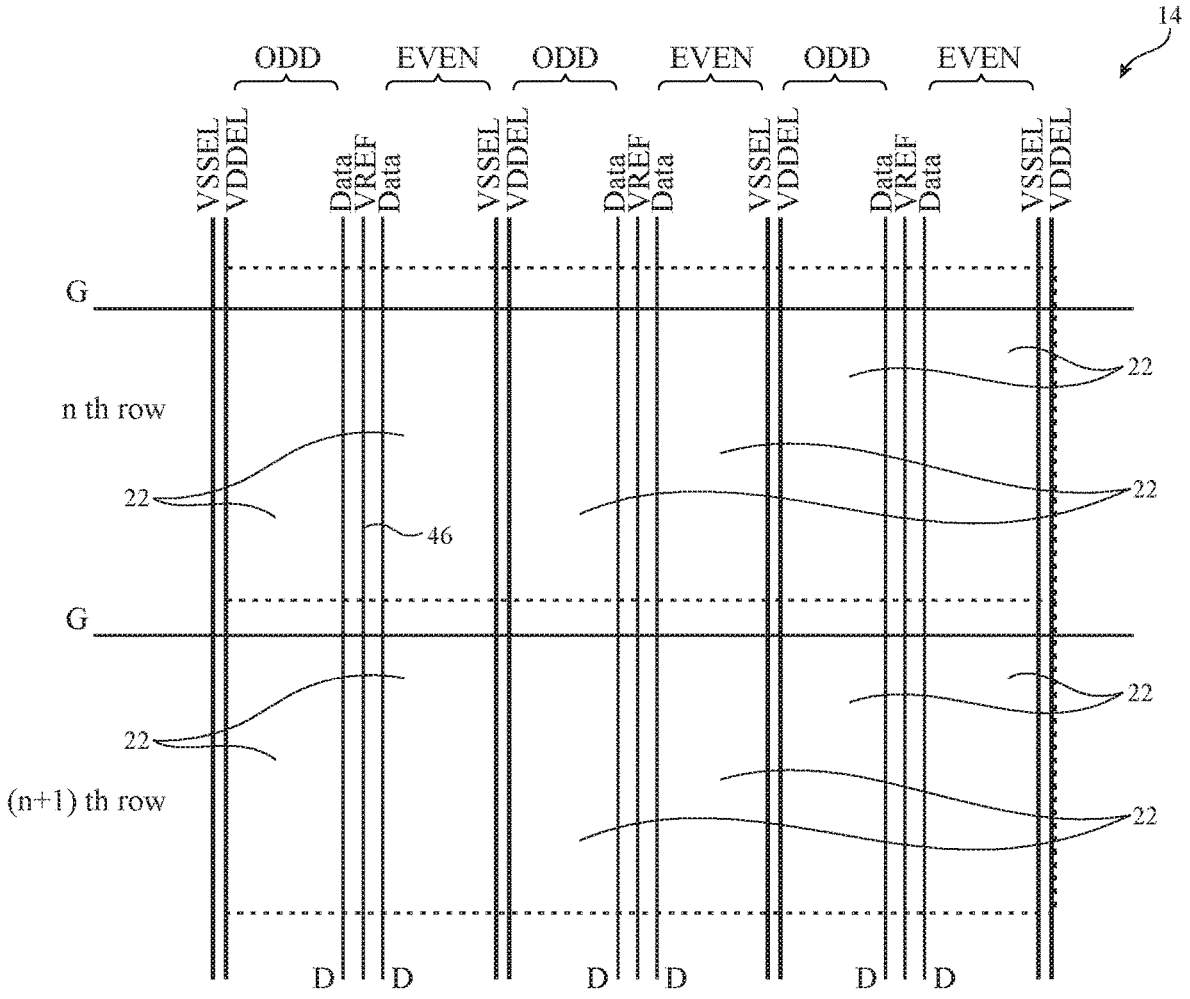
FIG. 7 is a top view of a portion of a display with power supply lines, data lines, and control lines in accordance with an embodiment.

FIG. 7 is a top view of a portion of display 14 showing an illustrative layout for power supply lines Vssel and Vddel and for reference line 46 and data lines DATA (sometimes referred to as data lines D). The illustrative layout of FIG. 8 allows each reference line 46 to be shared between an adjacent even column of pixels 22 and odd column of pixels 22 and allows each power supply line Vssel and each power supply line Vddel to be shared between adjacent even and odd columns of pixels 22. The layout of each pixel circuit 40 in each even column may have mirror symmetry with the layout of each pixel circuit 40 in an adjacent odd column. Data lines DATA may extend vertically through pixels 22 in pairs. Each pair of data lines may include a first data line for loading data into an odd column of pixels 22 and a second data line for loading data into an even column of pixels 22.

Figure 8:
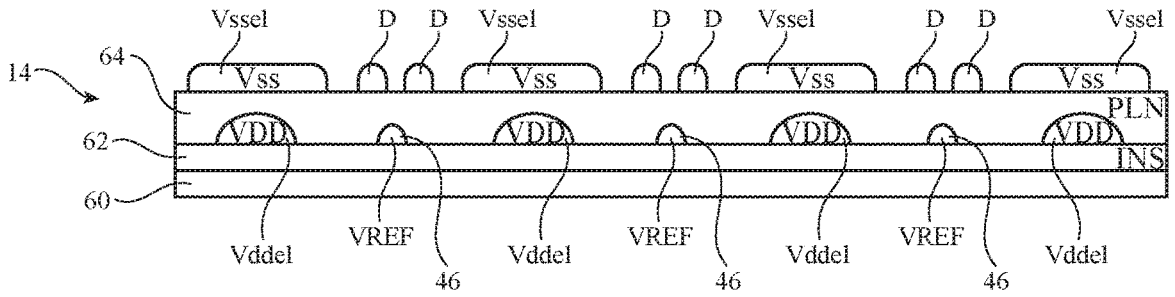
FIG. 8 is a cross-sectional side view of an illustrative display in accordance with an embodiment.
Figure 14:
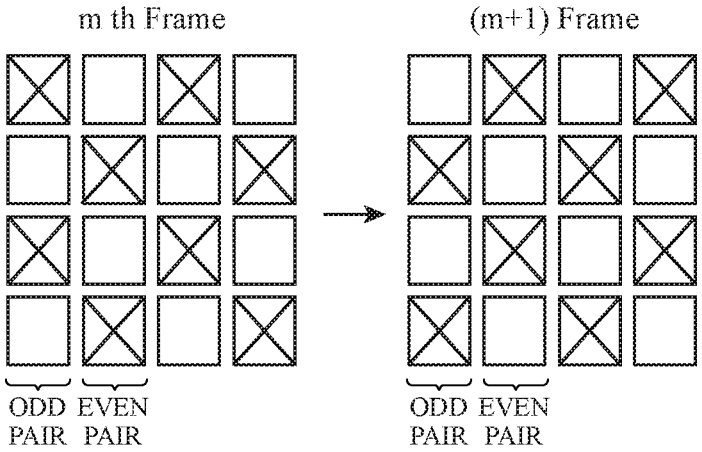
FIG. 14 is a diagram corresponding to pixel loading patterns in successive frames using the signals of FIG. 13 in accordance with an embodiment.

A cross-sectional side view of display 14 of FIG. 14 is shown in FIG. 8. As shown in FIG. 8, dielectric layer 62 may be formed on lower thin-film transistor circuitry layers, a substrate layer and/or other layers (see, e.g., layer 60). Power supply lines Vddel and reference lines 46 may be formed on layer 62. Planarization layer 64 may cover these lines and layer 62. Power supply lines Vssel and data lines D (e.g., data lines running parallel to each other in pairs) may be formed on layer 64.

In configurations for display 14 with mirror symmetry pixel layouts and pairs of data lines of the type shown in FIGS. 7 and 8, the space consumed by signal lines can be reduced by consolidating signal lines such as the power supply lines and reference voltage lines. However, parasitic capacitances between adjacent data lines D in each pair of data lines may arise (see, e.g., parasitic capacitances Cpara of FIG. 9). If care is not taken (e.g., if odd and even columns of pixels are loaded separately), there is a potential for capacitive coupling between the even column data lines and the odd column data lines to adversely affect the accuracy of loaded data.

To address this concern, data can be driven onto the data lines of each pair of data lines simultaneously. Demultiplexing circuitry 20A-2 may be used to reduce fanout between circuit 20A-1 and data lines D. To accommodate the use of demultiplexing circuitry 20A-2 in a configuration for display 14 with pairs of simultaneously driven data lines, demultiplexing circuitry 20A-2 can alternate between a first state in which odd pairs of columns are loaded and a second state in which even pairs of columns are loaded.

Figure 9:
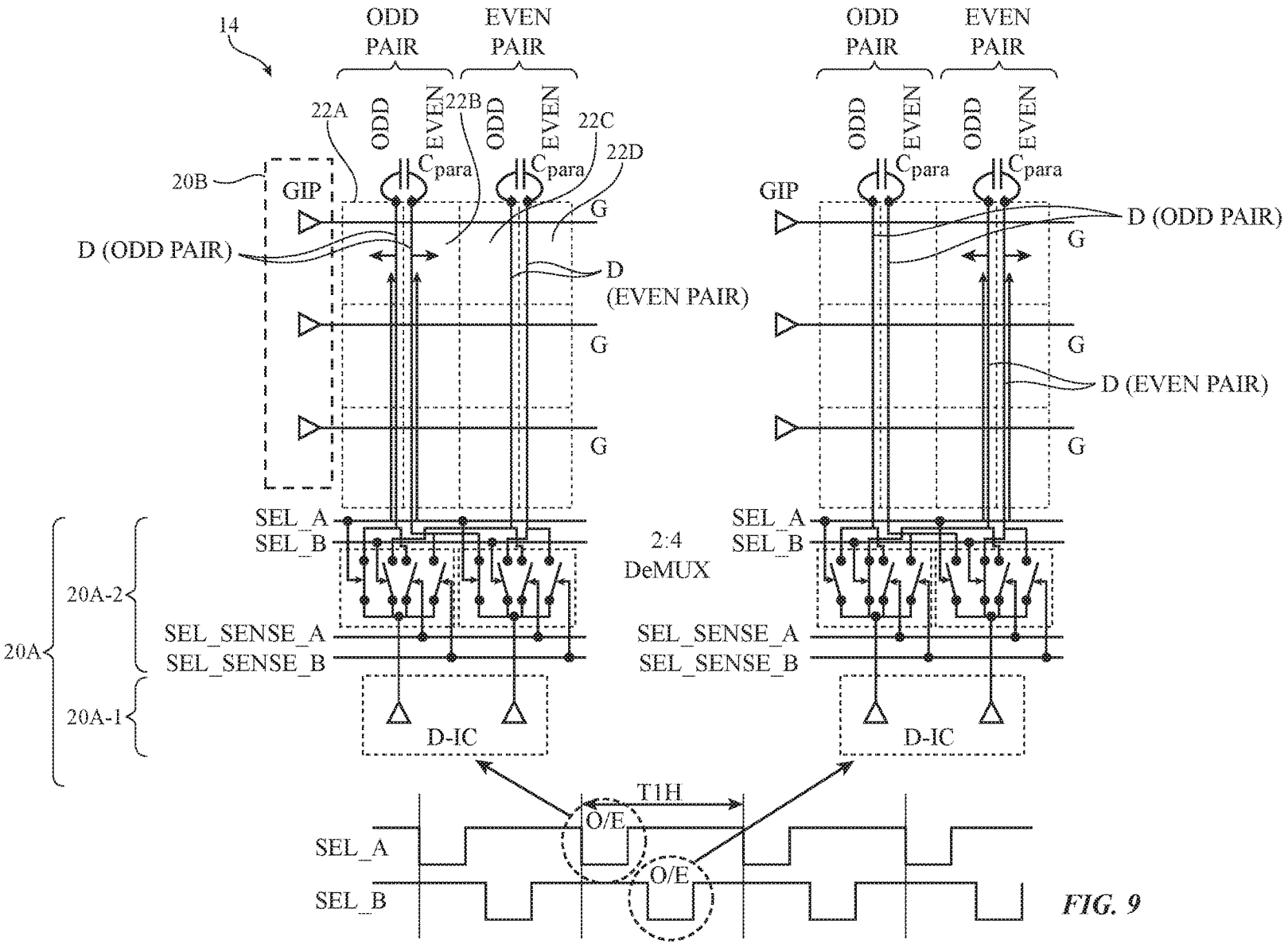
FIG. 9 is a diagram showing how display demultiplexer circuitry may be operated during data loading in accordance with an embodiment.

This type of arrangement is shown in FIG. 9. As shown in FIG. 9, demultiplexing circuitry 20A-2 may be dynamically configured in accordance with control signals (sometimes referred to as clock signals CLK1 and CLK2) such as SEL_A and SEL_B. When SEL_A is taken low, data is loaded from demultiplexer circuitry 20A-2 into odd pairs of columns and when SEL_B is taken low data is loaded into even pairs of columns. For example, when SEL_A is taken low, data is located into pixels 22A and 22B of each odd column pair using data lines D(ODD PAIR) and when SEL_B is taken low, data is located into pixels 22C and 22D of each even column pair using data lines D(EVEN PAIR). The alternating column pair loading pattern used in FIG. 9, which may be used during the operations of blocks 50 and 54 of FIG. 6, may help enhance data loading accuracy.

Figure 10:
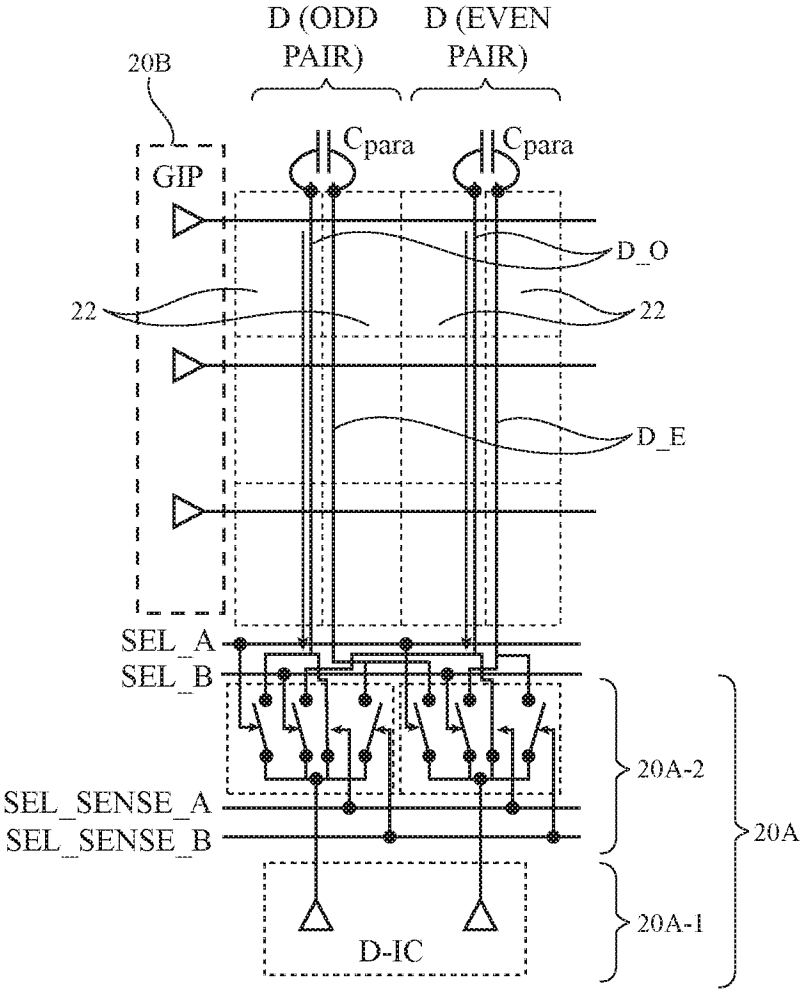
FIG. 10 is a diagram showing how display demultiplexer circuitry may be operated during current sensing operations in accordance with an embodiment.

As shown in FIG. 10, pixel sensing (e.g., sensing operations to measure currents for threshold voltage compensation during the operations of block 52 of FIG. 6), may use a different pattern of data lines. In particular, during sensing operations, demultiplexer circuitry 20A-2 may be configured to alternate between a first state in which first and second odd data lines D_O from first and second adjacent column pairs (e.g., ODD PAIR and EVEN PAIR) are used to provide current measurements to circuitry 20A-1 and a second state in which first and second even data lines D_E from the first and second adjacent columns pairs are switched into use for current sensing. Differential current sensing may be used to mitigate the impact of potential fabrication variations (e.g., variations that might make the capacitive coupling different between a gate line G and a first data line relative to the capacitive coupling between that gate line and a second data line that is paired with the first data line). The use of differential sensing may help remove common mode noise from horizontal lines such as gate lines G that overlap the data lines.

Figure 11:
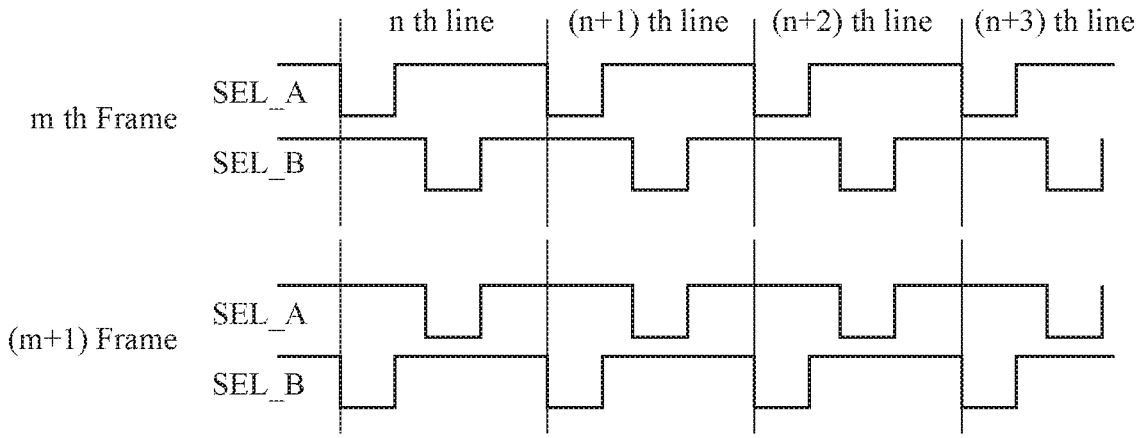
FIG. 11 is a timing diagram of illustrative data loading control signals for two successive frames in accordance with an embodiment.
Figure 12:
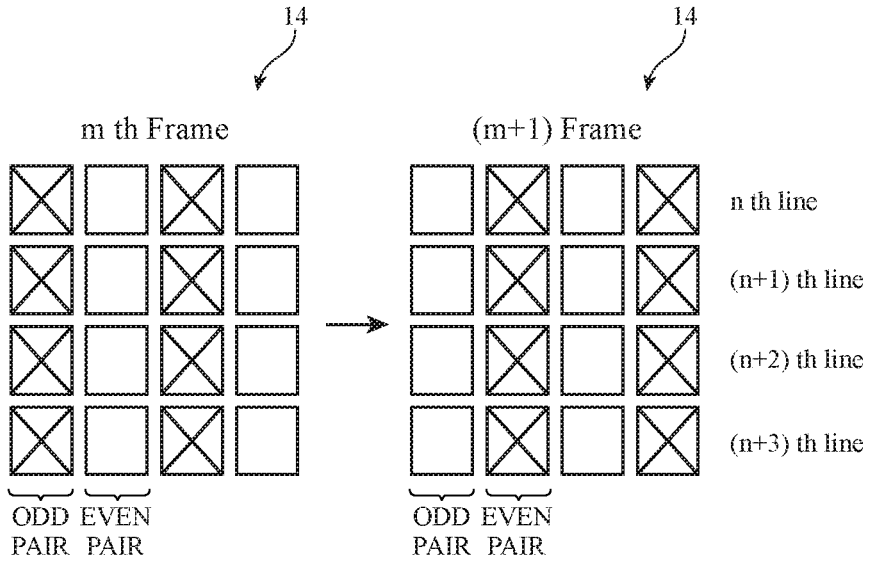
FIG. 12 is a diagram corresponding to pixel loading patterns in successive frames using the signals of FIG. 11 in accordance with an embodiment.
Figure 13:
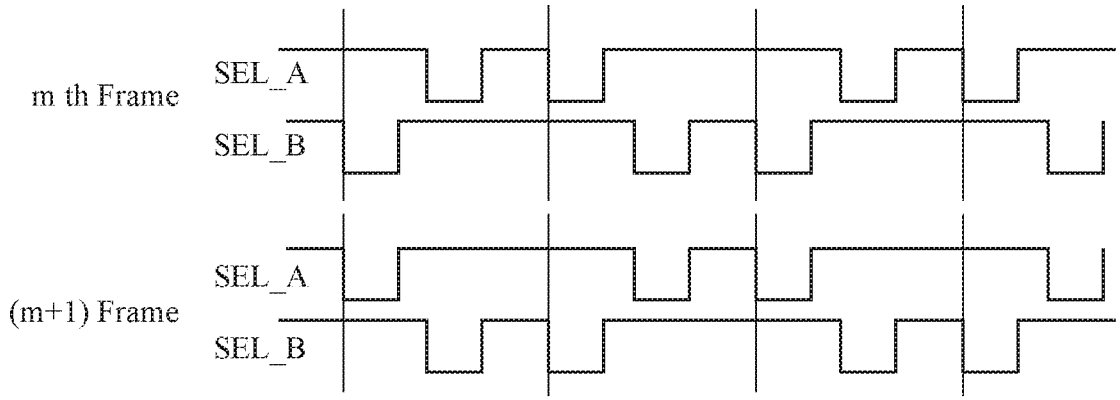
FIG. 13 is a timing diagram of additional illustrative data loading control signals for two successive frames in accordance with an embodiment.

The patterns used for loading and sensing may, if desired, vary between frames. As shown in the timing diagram of FIG. 11 and the corresponding pixel loading patterns for frames m and m+1 in FIG. 12, for example, the column pairs that are loaded may vary between frames. In frame m, odd column pairs may be loaded. In frame m+1, even column pairs may be loaded. This alternating pattern can help reduce artifacts from capacitive coupling between adjacent pairs of columns (and associated adjacent pairs of data lines). FIGS. 13 and 14 show an arrangement in which both column pair and row alternations are used (e.g., to form an alternating checkerboard pattern of loaded sets of pixels between respective frames). Other time varying patterns may be used, if desired.

Figure 15:
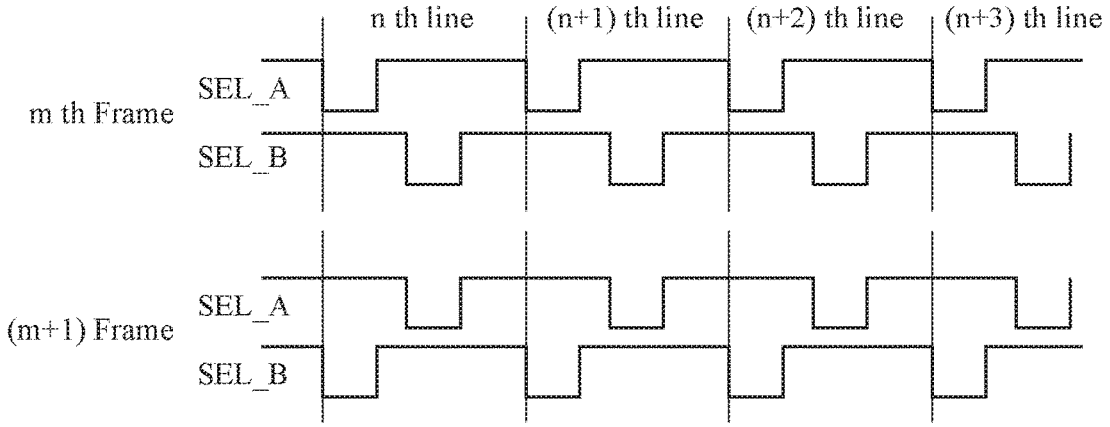
FIG. 15 is a timing diagram of illustrative current sensing control signals for two successive frames in accordance with an embodiment.
Figure 16:
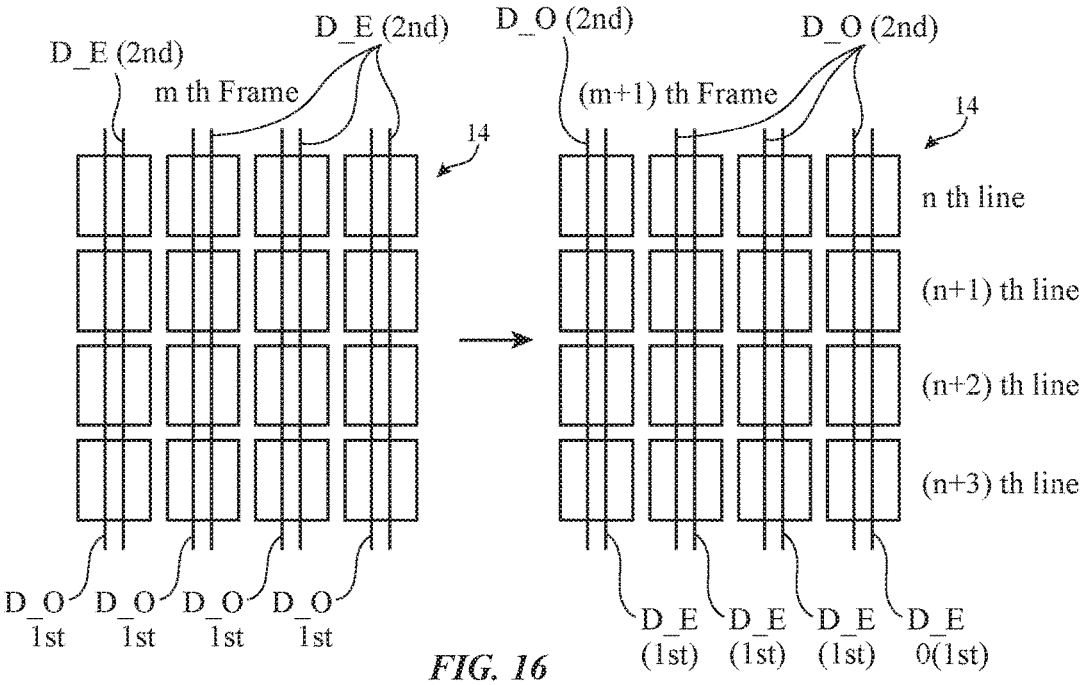
FIG. 16 is a diagram corresponding to pixels being sensed during the successive frames of FIG. 15 in accordance with an embodiment.

An illustrative arrangement for varying the pattern of data lines used during sensing between successive frames is shown in the timing diagram of FIG. 15 and the corresponding pixel and data line diagrams for frames m and m+1 in FIG. 16. As shown in FIGS. 15 and 16, in the mth frame, odd data lines D_O (e.g., pairs of lines for differential sensing)

may be switched into use before switching even data lines D_E into use. In the m+1$^{st}$ frame, this pattern is reversed and even data lines D_E are used before odd data lines D_O.

Figure 17:
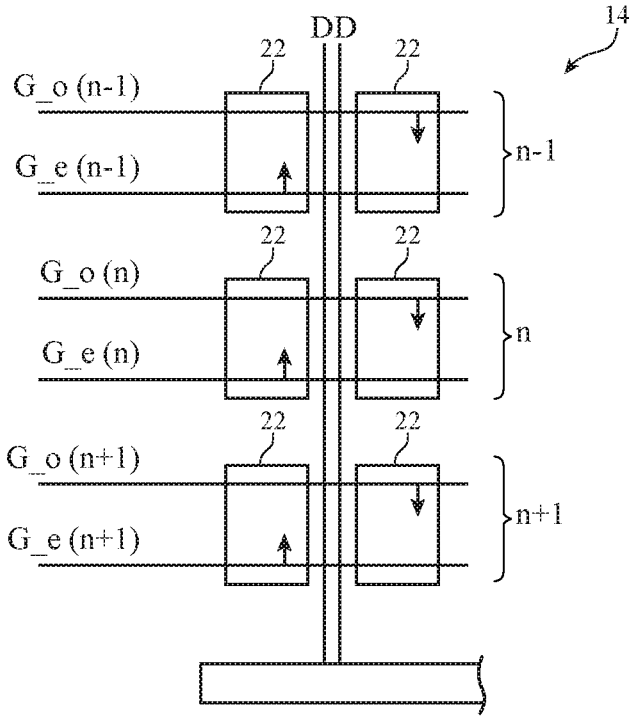
FIG. 17 is a diagram of illustrative pixels in a display in accordance with an embodiment.
Figure 18:
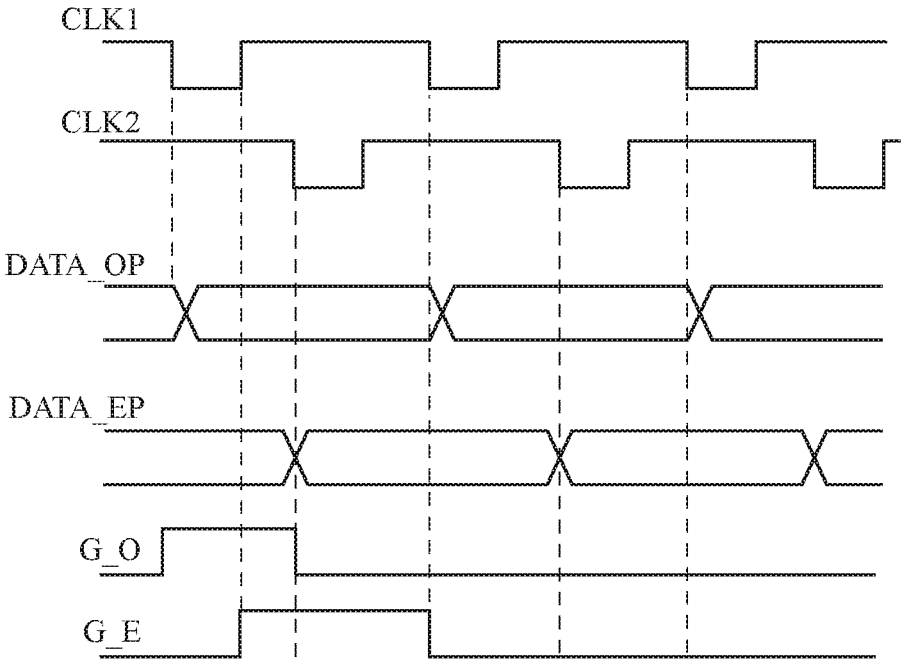
FIG. 18 is a timing diagram of illustrative control signals for operating the circuitry of FIG. 17 in accordance with an embodiment.

An alternative configuration for loading pixels 22 is shown in the pixel diagram of FIG. 17 and the corresponding timing diagram of FIG. 18. In this arrangement, each row of pixels 22 shares two gate lines (or sets of gate lines) such as odd gate lines G_O and even gate lines G_E. When CLK1 is asserted (e.g., taken low), odd pairs of columns are selected by demultiplexer circuitry 20A-2. When CLK2 is asserted (e.g., taken low), even pairs of columns are selected. Gate signals on odd lines G_O are asserted and deasserted in accordance with the falling edges of CLK1 and CLK2, respectively. Gate signals on even lines G_E are asserted and deasserted in accordance with the falling edges of CLK2 and CLK1, respectively. During the period of time in which each pair of data lines is loaded with data, first the odd gate line and then the even gate line is asserted, thereby loading the left-hand pixel 22 and then the right-hand pixel associated with that pair of data lines.

Figure 19:
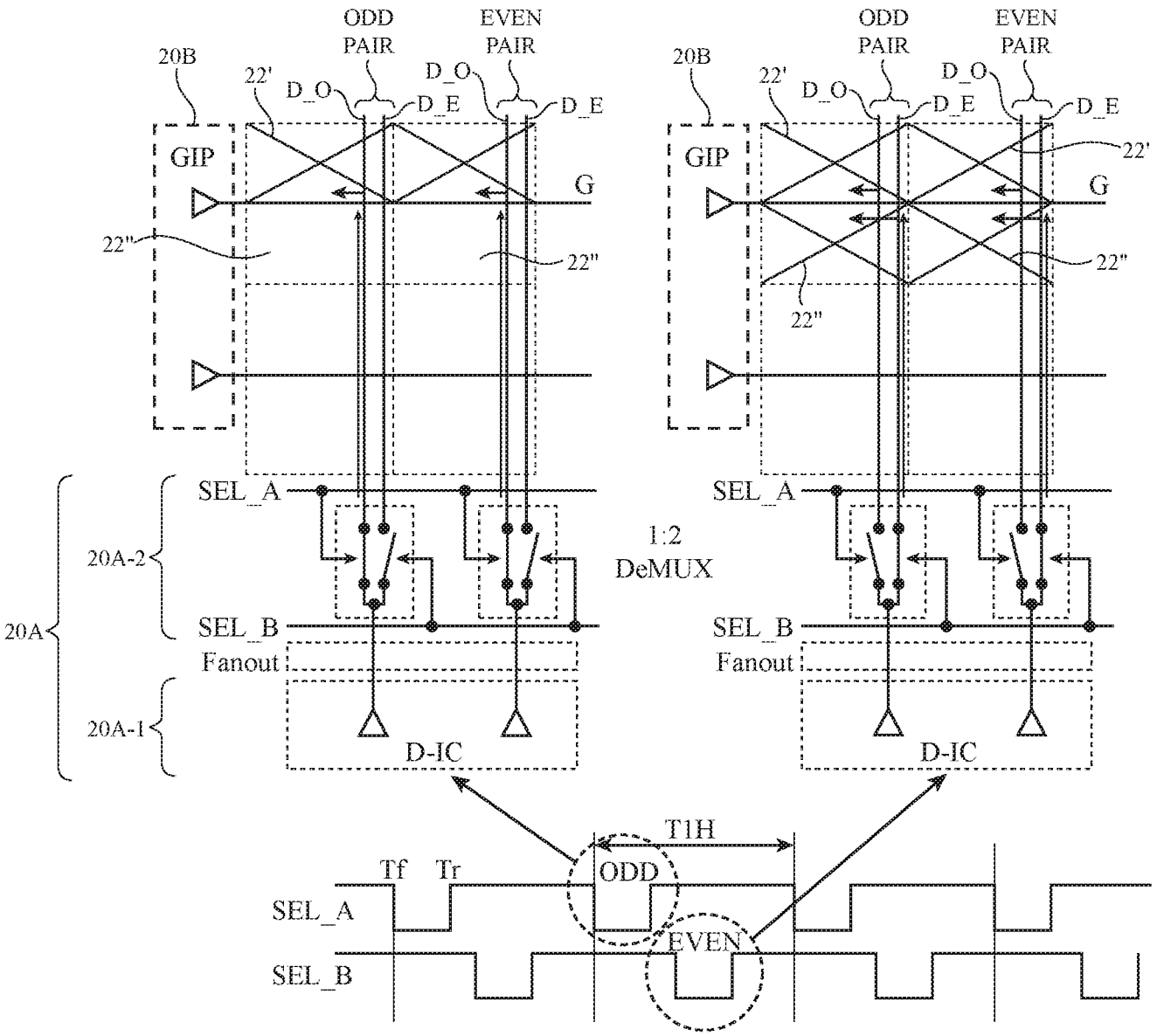
FIGS. 19, 20, and 21 illustrate data loading operations in accordance with embodiments.
Figure 20:
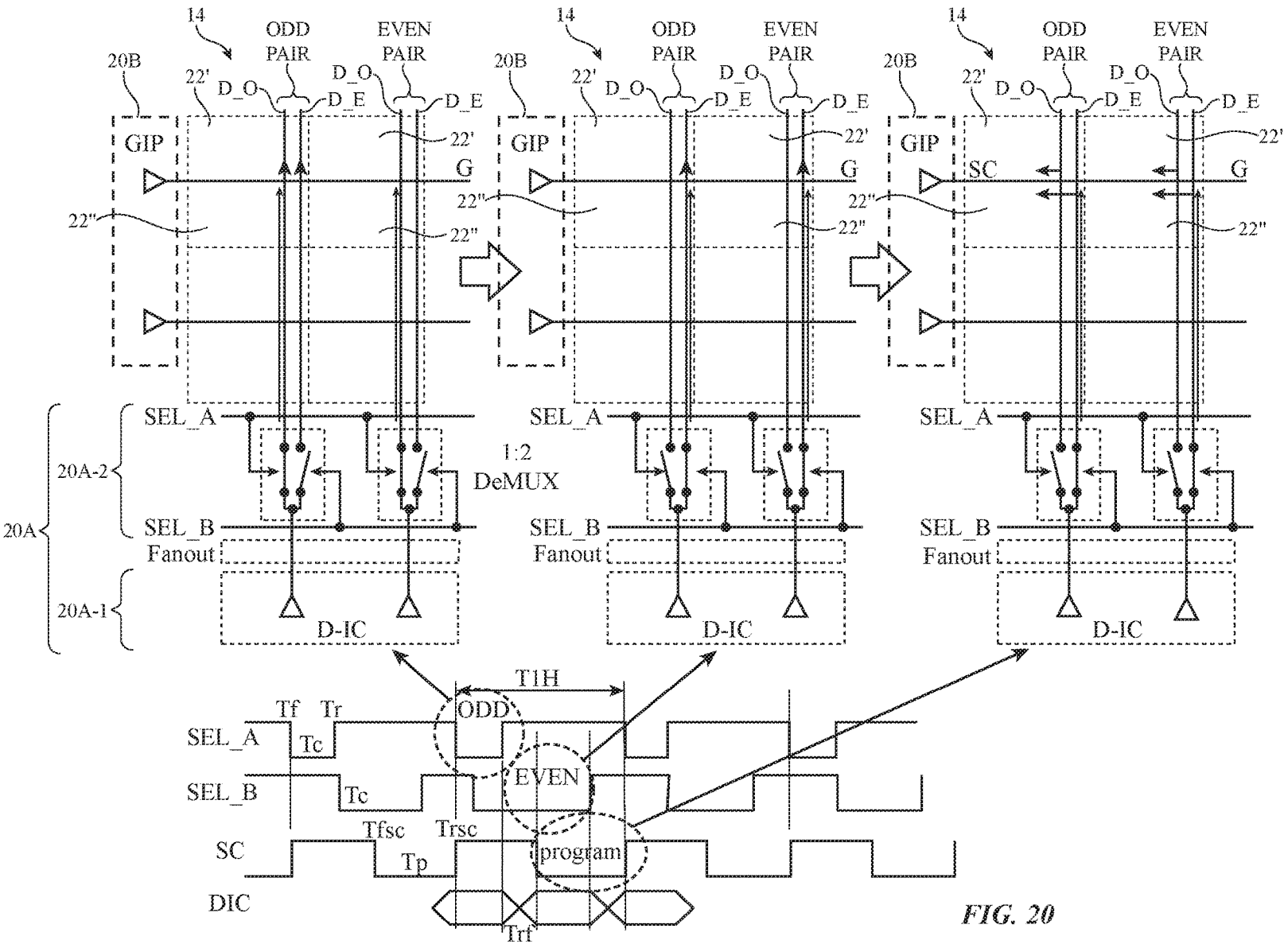

FIGS. 19, 20, and 22 show additional illustrative arrangements for loading pixels 22 in display 14. In the configuration of FIG. 19, a gate line G in a given row is asserted while (in a first demultiplexer state) odd date lines D_O are used in providing data to a first row of pixels 22' that are associated with the asserted gate line G and (in a second demultiplexer state) even data lines D_E are used in providing data to a second row of pixels 22" that are associated with the asserted gate line G.

FIG. 20 shows an illustrative configuration in which (1) odd date lines D_O are provided with data and are then left floating, (2) even data lines D_E are provided with data and are then left floating, and (3) gate control signal SC is asserted on a gate line G to load data from the odd data lines into a first row of pixels 22' associated with the gate line and to load data from the even data lines into a second row of pixels 22" associated with the gate line.

Figure 21:
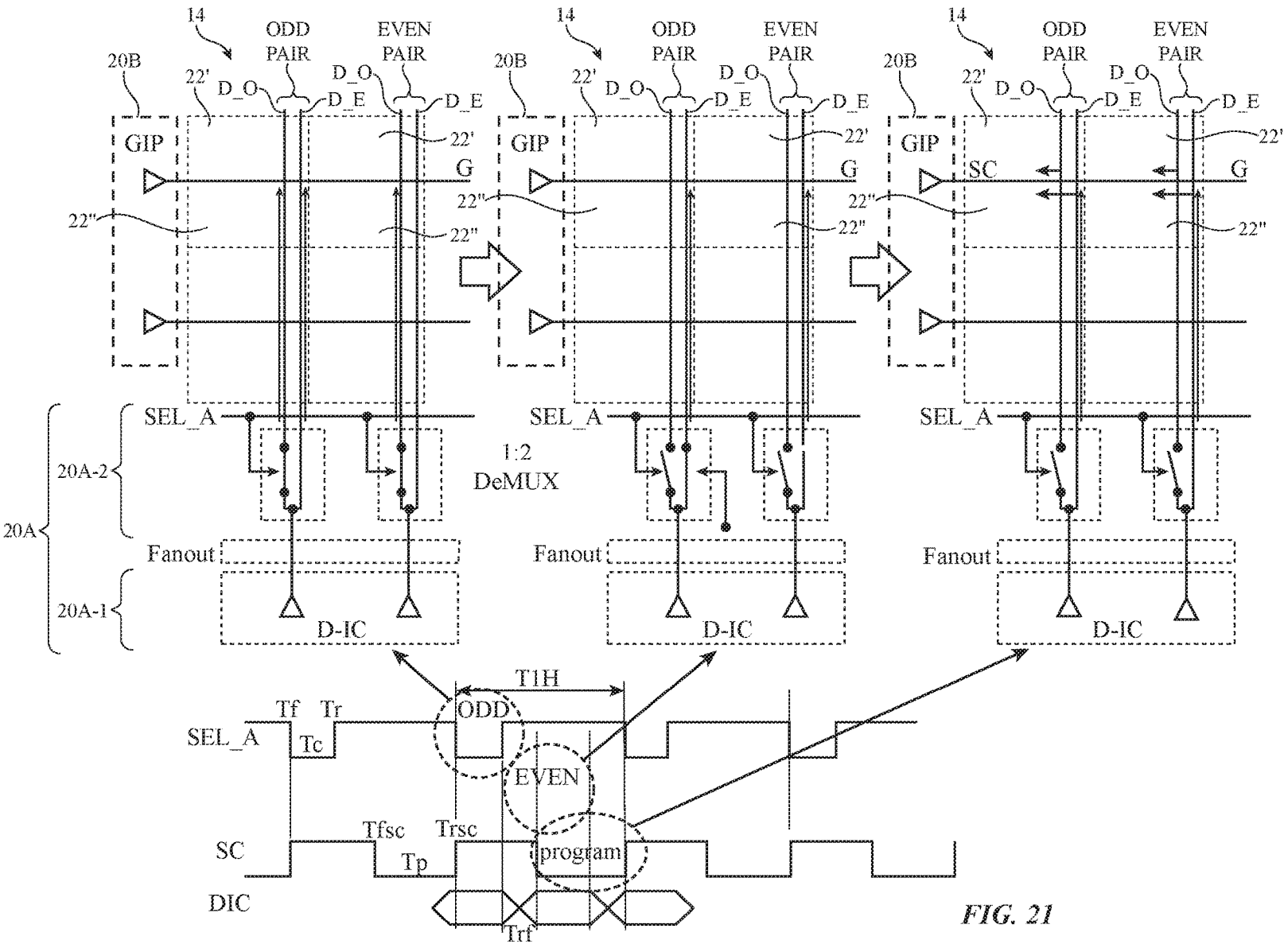

FIG. 21 shows an illustrative configuration in which demultiplexer 20A-2 uses 1:2 demultiplexer circuits. Demultiplexer 20A-2 first provides odd data lines D_O with data while both the odd and even lines are coupled to the input of each 1:2 demultiplexer. After switching the state of demultiplexer 20A-2, data is provided to even data lines D_E. After loading the odd and even data lines with data in this way, the pixels are loaded (programmed). During programing, gate line G supplies signal SC (signal SC is taken low) and a first row of pixels 22' associated with the gate line G is loaded with data from the odd data lines D_O while a second row of pixels 22" is loaded with data from the even data lines D_E.

The foregoing is merely illustrative and various modifications can be made to the described embodiments. The foregoing embodiments may be implemented individually or in any combination.

What is claimed is:

1. A display, comprising:

rows and columns of pixels, wherein the columns include alternating odd and even columns;

gate lines that are configured to supply gate signals to the rows;

data lines including odd data lines in the odd columns and even data lines in the even columns, wherein the data lines include pairs of data lines each of which includes one of the odd data lines and an adjacent one of the even data lines and wherein the pairs of data lines include odd pairs of data lines alternating with even pairs of data lines;

demultiplexer circuitry coupled to the data lines; and display driver circuitry coupled to the demultiplexer circuitry, wherein the demultiplexer circuitry is configured to load data from the display driver circuitry into a row in the rows of pixels using only the odd pairs of data lines in a first time period and into the row using only the even pairs of data lines in a second time period.

2. The display defined in claim 1, wherein the demultiplexer is configured to load a first frame of the data into the pixels by loading the odd pairs of data lines before the even pairs of data lines and is configured to load a second frame of the data into the pixels after the first frame by loading the even pairs of data lines before the odd pairs of data lines.

3. The display defined in claim 1, wherein the demultiplexer circuitry is configured to operate in a first sensing state in which sensed signals from the pixels are routed to the display driver circuitry from pairs of the even data lines and a second sensing state in which sensed signals from pixels are routed to the display driver circuitry from pairs of the odd data lines.

4. The display defined in claim 3, wherein the demultiplexer is configured to route the sensed signals from the pixels in different patterns in alternating frames.

5. The display defined in claim 1 further comprising positive power supply lines and negative power supply lines, wherein each pair of the data lines is located respectively between a first of the positive power supply lines and a second of the positive power supply lines and is located respectively between a first of the negative power supply lines and a second of the negative power supply lines.

6. The display defined in claim 5 further comprising reference voltage lines, wherein each of the reference voltage lines is located between one of the first negative power supply lines and one of the second negative power supply lines that is adjacent to that first negative power supply line.

7. A display, comprising:

rows and columns of pixels;

gate lines that are configured to supply gate signals to the rows;

data lines including alternating odd and even data lines, wherein the data lines include odd and even pairs of data lines each including one of the odd data lines and an adjacent one of the even data lines, wherein each column of the pixels includes a respective one of the pairs of the data lines;

demultiplexer circuitry coupled to the data lines; and display driver circuitry coupled to the demultiplexer circuitry, wherein the demultiplexer circuitry is configured to provide the pixels of each column with data from the display driver circuitry using the pair of data lines for that column and wherein the demultiplexer circuitry is configured to operate alternately in:

a first mode in which the demultiplexer circuitry provides data from the display driver circuitry to only the odd pairs of data lines; and a second mode in which the demultiplexer circuitry provides data from the display driver circuitry to only the even pairs of data lines.

8. The display defined in claim 7, wherein the display driver circuitry is configured to supply the demultiplexer circuitry with first and second clock signals.

9. The display defined in claim 8, wherein the gate signals have pulse widths that are longer than pulse widths of the first and second clock signals.

10. The display defined in claim 7, wherein, along each column, the pixels are alternatively coupled to one of the odd data lines and one of the even data lines.

11. The display defined in claim 7 wherein the pixels comprise organic light-emitting diode pixels.

12. A display, comprising:

rows and columns of pixels;

gate lines that are configured to supply gate signals to the rows;

data lines including odd data lines in odd columns alternating with even data lines in even columns, wherein the data lines include pairs of data lines each of which includes one of the odd data lines and an adjacent one of the even data lines and wherein the pairs of data lines include odd pairs of data lines alternating with even pairs of data lines;

demultiplexer circuitry coupled to the data lines; and display driver circuitry coupled to the demultiplexer circuitry, wherein the demultiplexer circuitry is configured to operate in a first sensing state in which sensed signals from the pixels are routed to the display driver circuitry from only the even data line in each pair of data lines and a second sensing state in which sensed signals from pixels are routed to the display driver circuitry from only the odd data line in each pair of data lines.

13. The display defined in claim 12, wherein the demultiplexer circuitry is configured to load data into the data lines from the display driver circuitry using, alternately, the odd pairs of data lines and the even pairs of data lines.

14. The display defined in claim 13, wherein the demultiplexer is configured to load odd frames of data into the pixels by loading the odd pairs of data lines before the even pairs of data lines and is configured to load even frames of data into the pixels by loading the even pairs of data lines before the odd pairs of data lines.

15. The display defined in claim 12, wherein the demultiplexer is configured to route the sensed signals from the pixels in different patterns in alternating frames.

16. The display defined in claim 12 further comprising positive power supply lines, wherein each pair of the data lines is located between a first of the positive power supply lines and a second of the positive power supply lines that is adjacent to the first of the positive power supply lines.

17. The display defined in claim 12, wherein each row includes at least two of the gate lines.

18. The display defined in claim 17 further comprising:

gate driver circuitry configured to load data from one of the odd data lines into a first pixel in a given row by asserting a first gate line signal on a first gate line in the given row and configured to load data from an adjacent one of the even data lines into a second pixel in the given row by asserting a second gate line signal on a second gate line in the given row.

19. The display defined in claim 1, wherein the demultiplexer circuitry is configured to load data from the display driver circuitry into the pixels using only two select signals.

20. The display defined in claim 1, wherein each driver in the display driver circuitry is operable to load data into at most two pixels in a row of pixels.

* * * * *